US010451259B2

(12) United States Patent
Fischer et al.

(10) Patent No.: US 10,451,259 B2
(45) Date of Patent: Oct. 22, 2019

(54) HEADLIGHT, VEHICLE WITH HEADLIGHT AND METHOD FOR MONITORING A HEADLIGHT

(71) Applicant: Hella GmbH & Co. KGaA, Lippstadt (DE)

(72) Inventors: Bernd Fischer, Salzkotten (DE); Susanne Köhler, Lippstadt (DE); Philip Stroop, Schloβ Holte-Stukenbrock (DE); Benjamin Willeke, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 15/761,993

(22) PCT Filed: Sep. 13, 2016

(86) PCT No.: PCT/EP2016/071545

§ 371 (c)(1),
(2) Date: Mar. 21, 2018

(87) PCT Pub. No.: WO2017/050611

PCT Pub. Date: Mar. 30, 2017

(65) Prior Publication Data

US 2018/0274770 A1 Sep. 27, 2018

(30) Foreign Application Priority Data

Sep. 25, 2015 (DE) ..... 10 2015 116 211

(51) Int. Cl.

| | |
|---|---|
| ***F21K 9/278*** | (2016.01) |
| ***F21V 23/04*** | (2006.01) |
| ***F21S 41/14*** | (2018.01) |
| ***F21S 41/20*** | (2018.01) |
| ***F21S 41/32*** | (2018.01) |

(Continued)

(52) U.S. Cl.

CPC ..... *F21V 23/0457* (2013.01); *F21S 41/14* (2018.01); *F21S 41/16* (2018.01); *F21S 41/176* (2018.01); *F21S 41/28* (2018.01); *F21S 41/285* (2018.01); *F21S 41/30* (2018.01); *F21S 41/32* (2018.01); *F21S 45/70* (2018.01)

(58) Field of Classification Search

CPC ..... B60Q 1/0023; F21S 41/16; F21S 41/176; F21V 23/0457

See application file for complete search history.

(56) References Cited

U.S. PATENT DOCUMENTS

| | | | | |
|---|---|---|---|---|
| 2014/0168940 | A1 | 6/2014 | Shiomi et al. | |
| 2015/0023032 | A1 | 1/2015 | Kang | |
| 2016/0305626 | A1 * | 10/2016 | Tatara | F21S 41/14 |

FOREIGN PATENT DOCUMENTS

| | | | | |
|---|---|---|---|---|
| DE | 102012220481 | A1 | 5/2014 | |
| DE | 202015001682 | U1 * | 3/2015 | F21S 41/16 |

(Continued)

*Primary Examiner* — Sean P Gramling
*Assistant Examiner* — Keith G. Delahoussaye
(74) *Attorney, Agent, or Firm* — Husch Blackwell LLP

(57) ABSTRACT

A headlight featuring a laser light source and a converter for converting a short-wave laser beam generated by the laser light source into white light. The headlight also includes a light-forming element for creating a beam path using the white light of the laser light source, as well as an IR sensor for measuring the IR radiation generated by the converter.

21 Claims, 2 Drawing Sheets

(51) Int. Cl.

| | |
|---|---|
| ***F21S 41/16*** | (2018.01) |
| ***F21S 41/30*** | (2018.01) |
| ***F21S 41/176*** | (2018.01) |
| ***F21S 45/70*** | (2018.01) |

(56) References Cited

FOREIGN PATENT DOCUMENTS

| | | | |
|---|---|---|---|
| DE | 202015001682 | U1 | 4/2015 |
| EP | 2461092 | A2 | 6/2012 |
| JP | 2011066069 | A | 3/2011 |

* cited by examiner

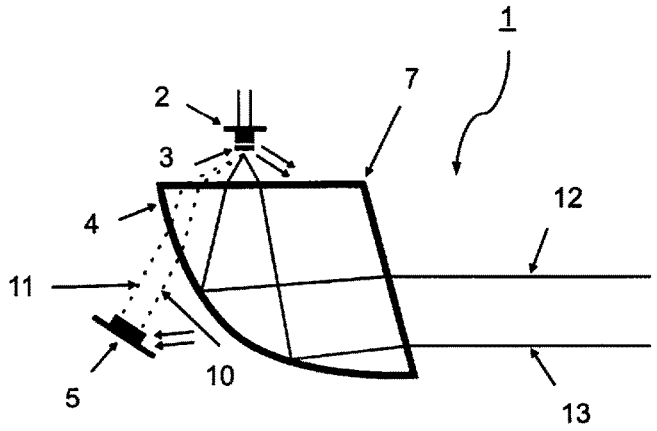
Fig. 4
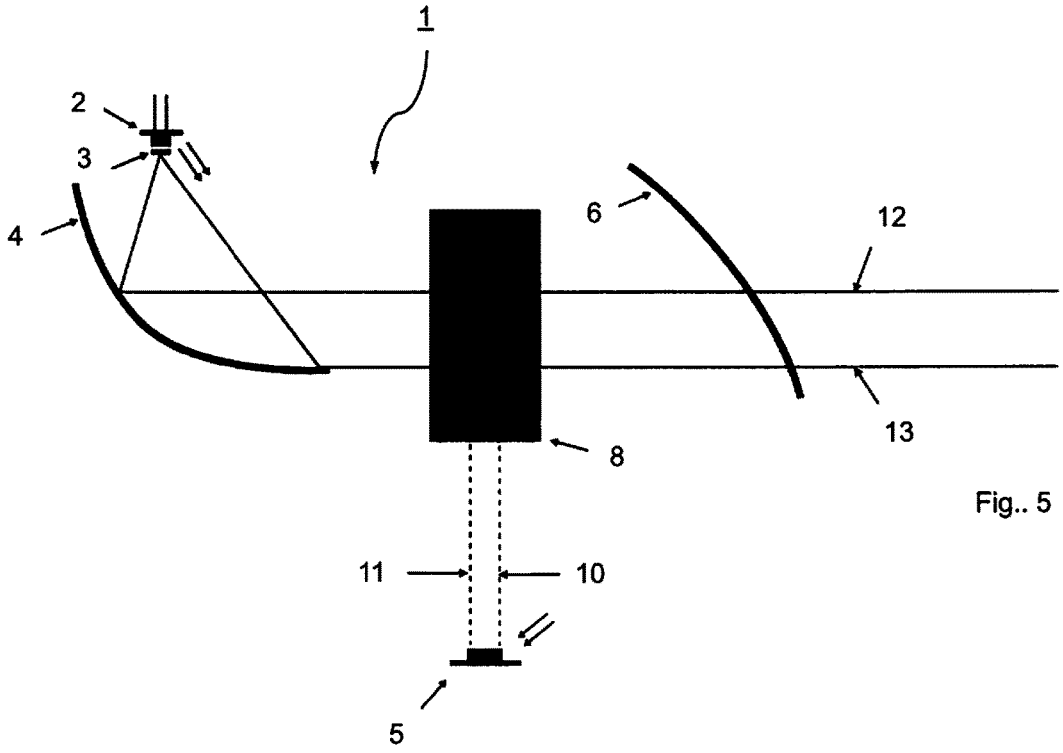
Fig.. 5

HEADLIGHT, VEHICLE WITH HEADLIGHT AND METHOD FOR MONITORING A HEADLIGHT

CROSS REFERENCE

This application claims priority to PCT Patent Application No. PCT/EP2016/071545, filed 13 Sep. 2016, which itself claims priority to German Patent Application 10 2015 116211.3, filed 25 Sep. 2015, the entirety of both of which are hereby incorporated by reference.

FIELD OF THE INVENTION

The invention concerns a headlight in addition to a vehicle equipped with the headlight. Furthermore, the invention concerns a method for monitoring the headlight.

BACKGROUND

In vehicle headlights, a wide variety of optical systems are used. These systems use light bulbs, LEDs and lasers as light sources. Standard optical systems frequently include reflectors implemented as direct or indirect reflectors, Fresnel lenses or other lenses and light-guiding lenses in a variety of forms.

Laser light sources can be used to generate a very high luminous flux in comparison to other light sources as a result of their very high luminance. From the perspective of optics and illumination, this property offers numerous advantages in lighting technology. Laser light sources are relevant to lighting technology in cases where the narrow light beam emitted from the laser (e.g. blue) is converted into a wider beam of light (e.g. white) by a converter element (e.g. yellow phosphorus).

However, laser light has the potential to damage the eye or even cause blindness under certain circumstances. This may happen if the converter is damaged in some way.

The established state of the art of technology uses photo diodes to detect damage in the headlight. Headlight damage can only be detected from the total luminous flux over a certain range of wavelengths. One disadvantage of the current state is that there must always be an opaque component, i.e. a filter and sensor, present in the middle of the light image or a select portion of the total luminous intensity distribution must be removed for the purpose of damage detection and is lost as a result.

Another option from the known state of the art of technology involves using scattered light for monitoring, since scattered light is already being lost from the useful light current. The disadvantage of this variation, however, is that the signal-to-noise ratio is relatively large, making the technique relatively imprecise.

SUMMARY OF THE INVENTION

The function of this invention is to overcome the disadvantages of the state of the technology. One goal of the approach is to monitor the headlight with components that are cost-effective and easy to manufacture.

The particular advantage of the invention is that it can monitor the laser safety of the headlight using an IR radiation measurement. The IR sensor can be used to measure the IR radiation generated by the converter.

When converting the blue exciting laser beam in the luminescent material of the laser light source, approx. 20% of the energy is converted into heat. A portion of this heat is emitted from the luminescent material in the form of thermal radiation, i.e. IR radiation.

The object of this invention is to use the thermal radiation of the luminescent material as a measure of the laser safety of the headlight. Since the generated heat is proportional to the blue laser beam introduced into the luminescent material, the thermal radiation in the luminescent material would decrease in the event of an error (e.g. destroyed luminescent material, broken luminescent material ceramics, etc.), i.e. in the event of escaping radiation flux that exceeds the permitted limit values for the eye. The IR radiation remains proportional to the amount of heat generated in the luminescent material.

If the laser light source and the converter are sufficiently well characterized, then the ratio of potentially hazardous blue radiation to the emitted IR radiation is known for each switching state. If the measured IR radiation deviates from its target value, it can be inferred that a defect is present in the system, in which case a corresponding response is triggered.

Preferably, the laser light source is a device that generates a laser beam. Preferably, the laser light source features a laser diode. It is especially preferable for the laser light source to be set up so that it emits white light using the luminescent material. The luminescent material of the laser light source also generates the IR radiation.

Preferably, the converter is a device for converting short-wave light radiation into white light. It is preferable to understand "white light" as white light radiation. It is especially preferable for the IR radiation to be emitted upon converting the short-wave light radiation into white light. As a result, the IR radiation is created when the laser radiation is converted to white light.

Preferably, the IR sensor is a detector, pick-up or sensor for measuring or recording the IR radiation. IR radiation is infrared radiation, i.e. thermal radiation.

Preferably, an imaging IR detector is used to generate an image of the converter emitting the IR radiation on the receiver of the IR detector. A thermal image of the converter generated in this way is compared to boundary sample images. Exceeding the boundary sample images triggers a switch-off of the light source. Preferably, the imaging IR detector is connected to the IR sensor.

According to one embodiment of the invention, the light-forming element is a reflector.

The reflector can be used to reflect light. It is preferable for the reflector to have a curve. Providing curvature makes it possible to generate a beam path for the white light in the headlight.

According to one embodiment of the invention, the IR sensor is positioned outside of the beam path generated by the light-forming element.

It is preferable to have an IR filter upstream of the IR sensor. It is preferable for the IR filter to be developed to be transparent for rays in the visible wavelength range. Thanks to its transparency, the IR filter can be positioned in a variety of ways in the beam path for visible radiation without having adverse effects on the light image.

It is preferable for the IR filter to be used reflectively or in a way that transmits radiation in order to direct the light to the corresponding IR sensor. If this IR filter is transparent for visible radiation, it can be positioned in a wide variety of ways in the beam path without reducing the optical efficiency. In addition, scattered light can be used that is optimized for a high IR portion and therefore generates far less noise than the visible scattered light. This does not entail any reduction of the optical efficiency at a simultaneously high signal-to-noise ratio for the measured values.

According to one embodiment of the invention, a lens is positioned in the beam path generated by the light-forming element, where the lens features a material or coating in order to enable reflection of the IR radiation to the IR sensor.

Preferably, the lens is transparent for the visible radiation and only redirects IR radiation.

It is preferable for reflection to be a redirection of light for visible radiation or waves. It is preferable for the reflection to be a Fresnel reflection. It is particularly preferable for the lens to be a plastic lens.

According to one embodiment of the invention, the light-forming element features a refractive element, where the refractive element has a material or coating in order to enable the reflection and/or refraction of the IR radiation to the IR sensor.

According to one embodiment of the invention, the refractive element is designed to be light-guiding and/or light-forming.

Providing the refractive element makes it easy to carry out beam deflection and/or beam control.

According to one embodiment of the invention, a deflector is provided in order to make it possible to reflect the IR radiation to the IR sensor.

Preferably, the deflector is located outside of the beam path. Preferably, the deflector is positioned in the beam path if it is transparent for the visible radiation and only deflects IR radiation.

According to one embodiment of the invention, the IR sensor is set up to switch off the laser light source as soon as an IR radiation measurement falls below a certain IR emission limit value.

Preferably, the laser light source is switched off using a switch-off device in the headlight. Preferably, the switch-off device can be controlled by the IR sensor. Preferably, the IR emission limit value is defined.

BRIEF DESCRIPTION OF THE DRAWINGS

Reference is now made more particularly to the drawings, which illustrate the best presently known mode of carrying out the invention and wherein similar reference characters indicate the same parts throughout the views.

FIG. 4 shows a schematic cross-section of an additional alternative inventive headlight.

FIG. 5 shows a schematic cross-section of an additional alternative inventive headlight.

DETAILED DESCRIPTION OF THE DRAWINGS

Figure 1:
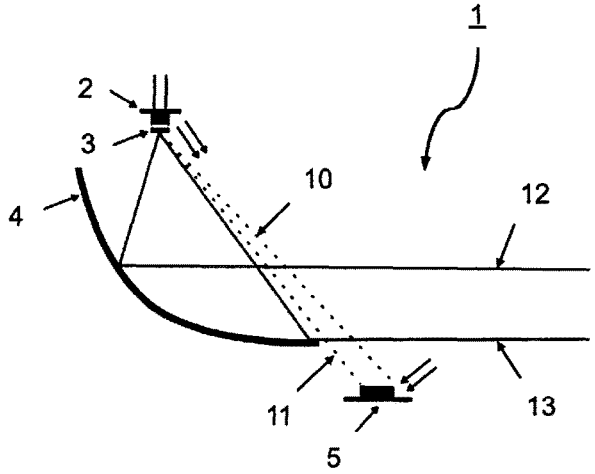
FIG. 1 shows a schematic cross-section of an inventive headlight.
Figure 3:
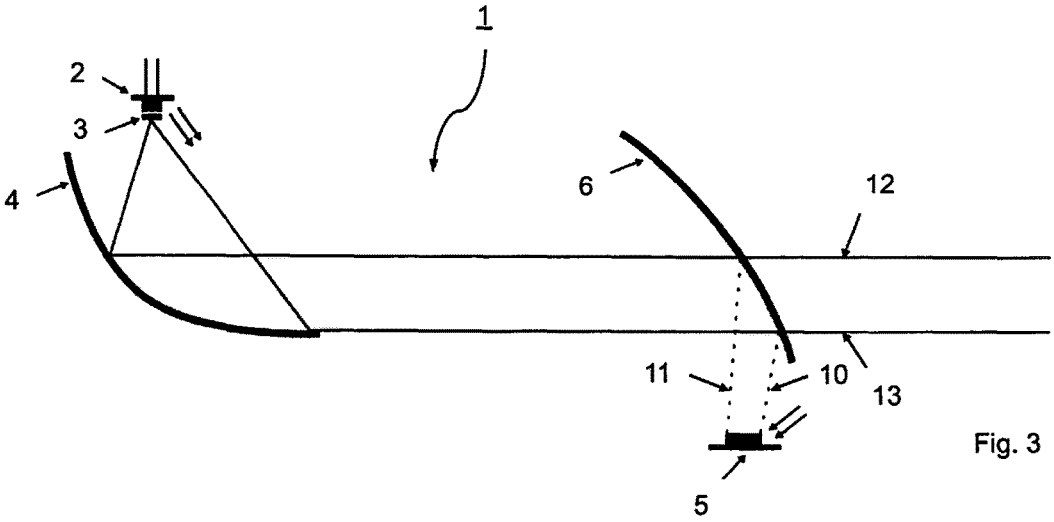
FIG. 3 shows a schematic cross-section of an additional alternative inventive headlight.

FIG. 1 shows a schematic cross-section of an inventive headlight (1). The headlight (1) has a laser light source (2) as its illuminant. In addition, the headlight features a converter (3) for converting a short-wave laser radiation generated by the laser light source (2) into white light (white laser radiation) and a light-forming element (4) for generating a beam path (12, 13) (indicated by boundary lines) from the white light of the laser light source (2). In addition, the headlight features an IR sensor (5) for measuring IR radiation (10, 11) generated by the converter (3) and indicated in FIG. 1 by dashed lines. The IR radiation (10, 11) is created when the laser beam is converted into white light. The light-forming element (4) is a reflector. The reflector reflects the white light through the established method. This results in the beam path (12, 13). The IR sensor (5) is positioned on the specific plane in an area below the lens (6) (the lens (6) is illustrated in FIGS. 3 and 5) and outside of the beam path (12, 13) generated by the light-forming element (4).

The IR sensor (5) is set up to switch off the laser light source (2) as soon as an IR radiation (10, 11) measurement falls below a certain IR emission limit value. The IR emission limit value for the white light has been defined in advance. The laser light source (2) is switched off using a switch-off device (not shown) in the headlight (1). Here, the IR sensor (5) is set up to actuate the switch-off device. The switch-off device itself switches off the laser light source (2) if necessary, i.e. if the IR emission falls below the limit value.

Providing the IR sensor (5) makes it possible to monitor the laser safety of the headlight (1) by measuring the generated IR radiation (10, 11).

Figure 2:
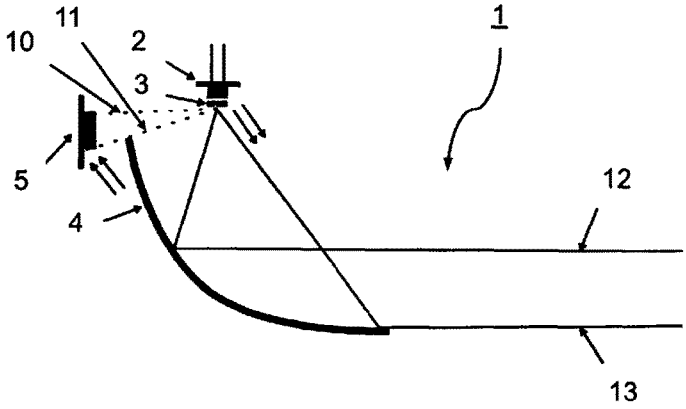
FIG. 2 shows a schematic cross-section of an alternative inventive headlight.

FIG. 2 shows a schematic cross-section of an alternative inventive headlight (1). Unlike FIG. 1, the IR sensor (5) is positioned on the specific plane in an area behind the light-forming element (4).

Providing the alternative inventive headlight (1) demonstrates the additional option to monitor the laser safety of the headlight (1).

FIG. 3 shows a schematic cross-section of an additional alternative inventive headlight (1). Unlike FIGS. 1 and 2, a lens (6) is positioned in the beam path (12, 13) generated by the light-forming element (4). The lens (6) has a coating that enables reflection of the IR radiation (10, 11) to the IR sensor (5) while also allowing white light to pass through. Here, the IR sensor (5) is positioned on the specific plane in an area below the light-forming element (4).

Providing the additional alternative inventive headlight (1) demonstrates the additional option to monitor the laser safety of the headlight (1).

FIG. 4 shows a schematic cross-section of an additional alternative inventive headlight (1). Unlike FIG. 1 through 3, the light-forming element (4) has a refractive element (7). The refractive element (7) features a coating that makes it possible to refract the IR radiation (10, 11) to the IR sensor (5). Here, the IR sensor (5) is positioned on the specific plane behind the light-forming element (4). The refractive element (7) is designed to be light-guiding and light-forming. The refractive element (7) makes it possible to implement beam deflection and beam control for the white light radiation and the IR radiation (10, 11) in the headlight (1).

Providing the additional alternative inventive headlight (1) demonstrates the additional option to monitor the laser safety of the headlight (1).

FIG. 5 shows a schematic cross-section of an additional alternative inventive headlight (1). Unlike FIG. 1 through 4, the headlight (1) features a deflector (8) positioned in the beam path (12, 13) generated by the light-forming element (4) in order to enable reflection of the IR radiation (10, 11) to the IR sensor (5). Here, the IR sensor (5) is positioned on the specific plane in an area below the deflector (8).

Providing the additional alternative inventive headlight (1) demonstrates the additional option to monitor the laser safety.

The previous explanation of the designs only describes this invention using examples. Of course, individual features of these designs can be combined with one another in any way without going beyond the scope of this invention, provided that these features are technologically useful.

REFERENCE NUMERAL LIST

1 Headlight
2 Laser
3 Converter
4 Light-forming element
5 IR sensor
6 Lens
7 Refractive element
8 Deflector
10 IR radiation
11 IR radiation
12 Beam path
13 Beam path

The invention claimed is:

1. A headlight comprising:
a laser light source;
a converter for converting a short-wave laser beam generated by the laser light source into white light;
a light-forming element for creating a beam path using the white light of the laser light source
an IR sensor for measuring the IR radiation generated by the converter; and
a lens is positioned in the beam path generated by the light-forming element, where the lens has a material or a coating that is configured to reflect the IR radiation to the IR sensor.

2. The headlight in accordance with claim 1, wherein the light-forming element is a reflector.

3. The headlight in accordance with claim 1, wherein the IR sensor is positioned outside of the beam path generated by the light-forming element.

4. The headlight in accordance with claim 1, wherein the light-forming element features a refractive element, whereby the refractive element features a material or a coating that is configured to reflect and/or refract the IR radiation to the IR sensor.

5. The headlight in accordance with claim 4, wherein the refractive element is configured for light-guiding and/or light-forming.

6. The headlight in accordance with claim 1, wherein a deflector is provided that is configured to reflect the IR radiation to the IR sensor.

7. The headlight in accordance with claim 1, wherein the IR sensor is set up to switch off the laser light source as soon as an IR radiation measurement decreases below a certain IR emission limit value.

8. A headlight comprising:
a laser light source;
a converter for converting a short-wave laser beam generated by the laser light source into white light;
a light-forming element for creating a beam path using the white light of the laser light source, wherein the light-forming element features a refractive element,
an IR sensor for measuring the IR radiation generated by the converter; and
the refractive element features a material or a coating that is configured to reflect and/or refract the IR radiation to the IR sensor.

9. The headlight in accordance with claim 8, wherein the light-forming element is a reflector.

10. The headlight in accordance with claim 8, wherein the IR sensor is positioned outside of the beam path generated by the light-forming element.

11. The headlight in accordance with claim 8, wherein a lens is positioned in the beam path generated by the light-forming element, where the lens has a material or a coating that is configured to reflect the IR radiation to the IR sensor.

12. The headlight in accordance with claim 8, wherein the refractive element is configured for light-guiding and/or light-forming.

13. The headlight in accordance with claim 8, wherein a deflector is provided that is configured to reflect the IR radiation to the IR sensor.

14. The headlight in accordance with claim 8, wherein the IR sensor is set up to switch off the laser light source as soon as an IR radiation measurement decreases below a certain IR emission limit value.

15. A headlight comprising:
a laser light source;
a converter for converting a short-wave laser beam generated by the laser light source into white light;
a light-forming element for creating a beam path using the white light of the laser light source; and
an IR sensor for measuring the IR radiation generated by the converter; and
a deflector is provided that is configured to reflect the IR radiation to the IR sensor.

16. The headlight in accordance with claim 15, wherein the light-forming element is a reflector.

17. The headlight in accordance with claim 15, wherein the IR sensor is positioned outside of the beam path generated by the light-forming element.

18. The headlight in accordance with claim 15, wherein a lens is positioned in the beam path generated by the light-forming element, where the lens has a material or a coating that is configured to reflect the IR radiation to the IR sensor.

19. The headlight in accordance with claim 15, wherein the light-forming element features a refractive element, whereby the refractive element features a material or a coating that is configured to reflect and/or refract the IR radiation to the IR sensor.

20. The headlight in accordance with claim 19, wherein the refractive element is configured for light-guiding and/or light-forming.

21. The headlight in accordance with claim 15, wherein the IR sensor is set up to switch off the laser light source as soon as an IR radiation measurement decreases below a certain IR emission limit value.

* * * * *